United States Patent [19]

Bould

[11] 4,163,133

[45] Jul. 31, 1979

[54] CIRCUIT BREAKER APPARATUS INCLUDING JACK SHAFT SUPPORT

[75] Inventor: Fred Bould, Edgewood Borough, Pa.

[73] Assignee: Westinghouse Electric Corp., Pittsburgh, Pa.

[21] Appl. No.: 907,074

[22] Filed: May 18, 1978

Related U.S. Application Data

[63] Continuation of Ser. No. 680,829, Apr. 28, 1976, abandoned.

[51] Int. Cl.[2] ..... H01H 3/30

[52] U.S. Cl. ..... 200/153 SC

[58] Field of Search ..... 200/153 R, 153 G, 153 LB, 200/153 SC; 74/97; 185/39, 40 R, 40 B

[56] References Cited

U.S. PATENT DOCUMENTS 3,569,652 3/1971 Hauser ..... 200/153 SC

FOREIGN PATENT DOCUMENTS 1080983 8/1967 United Kingdom .

*Primary Examiner*—Stephen Marcus

*Attorney, Agent, or Firm*—M. J. Moran

[57] ABSTRACT

A circuit breaker apparatus is taught having a jack shaft for actuating linkages to open and close the contacts of a three phase electrical system. There is provided an operating mechanism for transferring movement to the jack shaft for accomplishing the previously mentioned opening and closing operation. Support is provided at the jack shaft in close proximity to each of the three phase operating linkages. The bearing support for each of the outer poles is provided at the ends of the jack shaft. The bearing support for the inner pole is provided by one of the support members of the operating mechanism very near to that part of the jack shaft where the middle linkage is attached.

5 Claims, 12 Drawing Figures

CIRCUIT BREAKER APPARATUS INCLUDING JACK SHAFT SUPPORT

This is a continuation of application Ser. No. 680,829 filed Apr. 28, 1976, now abandoned.

CROSS-REFERENCE TO RELATED APPLICATIONS

The subject matter disclosed and claimed in this application is related to subject matter disclosed and claimed in copending, concurrently filed applications Ser. No. 681,274, by F. Bould; and Ser. No. 680,828, by F. Bould and P. M. Kowalik. Both of the above-mentioned copending applications are assigned to the assignee of the present application.

BACKGROUND OF THE INVENTION

1. Field of the Invention

The subject matter of this invention relates generally to support bearings for jack shafts in a circuit breaker apparatus and relates more specifically to the utilization of a portion of the circuit breaker apparatus operating mechanism as a support bearing.

2. Description of the Prior Art

It is known to provide an operating mechanism for a three phase circuit breaker apparatus. It is also known to support the jack shaft which is connected to the operating mechanism and to the contacts at the ends of the jack shaft. It would be advantageous if the jack shaft would be supported not only at the ends where forces from the two outside operating linkages are most strong, but also at the middle linkage where force is also strong. It would be further advantageous if one of the support members for the operating mechanism provided the dual function of also supporting the jack shaft in the region of the linkage for the middle pole of the three phase circuit breaker apparatus. One prior art apparatus which shows a typical prior art support arrangement for a three phase circuit breaker is shown in U.S. Pat. No. 3,183,332 issued May 11, 1965 to R. E. Frink et al and assigned to the same assignee as the assignee of the present invention.

SUMMARY OF THE INVENTION

In accordance with the invention, a circuit interrupter is taught which comprises a base having three separable contact means disposed thereupon. There are three lever means, one for each of the three separable main contacts for moving the contacts. There is a rotatable jack shaft means. The lever means are moved by rotation of the jack shaft means. The jack shaft means absorbs reaction force from the movement of the contact means. Each end of the jack shaft means is disposed in thrust bearing relationship upon the base for substantially bearing or absorbing the thrust from the two outer means of the three lever means as the contacts move. There is an operating mechanism which is also disposed upon the base. The operating mechanism actuates the jack shaft to rotate to move the contacts. The operating mechanism has a support means. The support means has a bearing surface thereon which engages the jack shaft relatively near the middle lever of the previously described three levers for thus bearing the thrust of the middle lever as the contact means moves to reduce deflection in the jack shaft.

BRIEF DESCRIPTION OF THE DRAWINGS

For a better understanding of the invention, reference may be had to the preferred embodiments exemplary of the invention, shown in the accompanying drawings, in which.

DESCRIPTION OF THE PREFERRED EMBODIMENT

Figure 1:
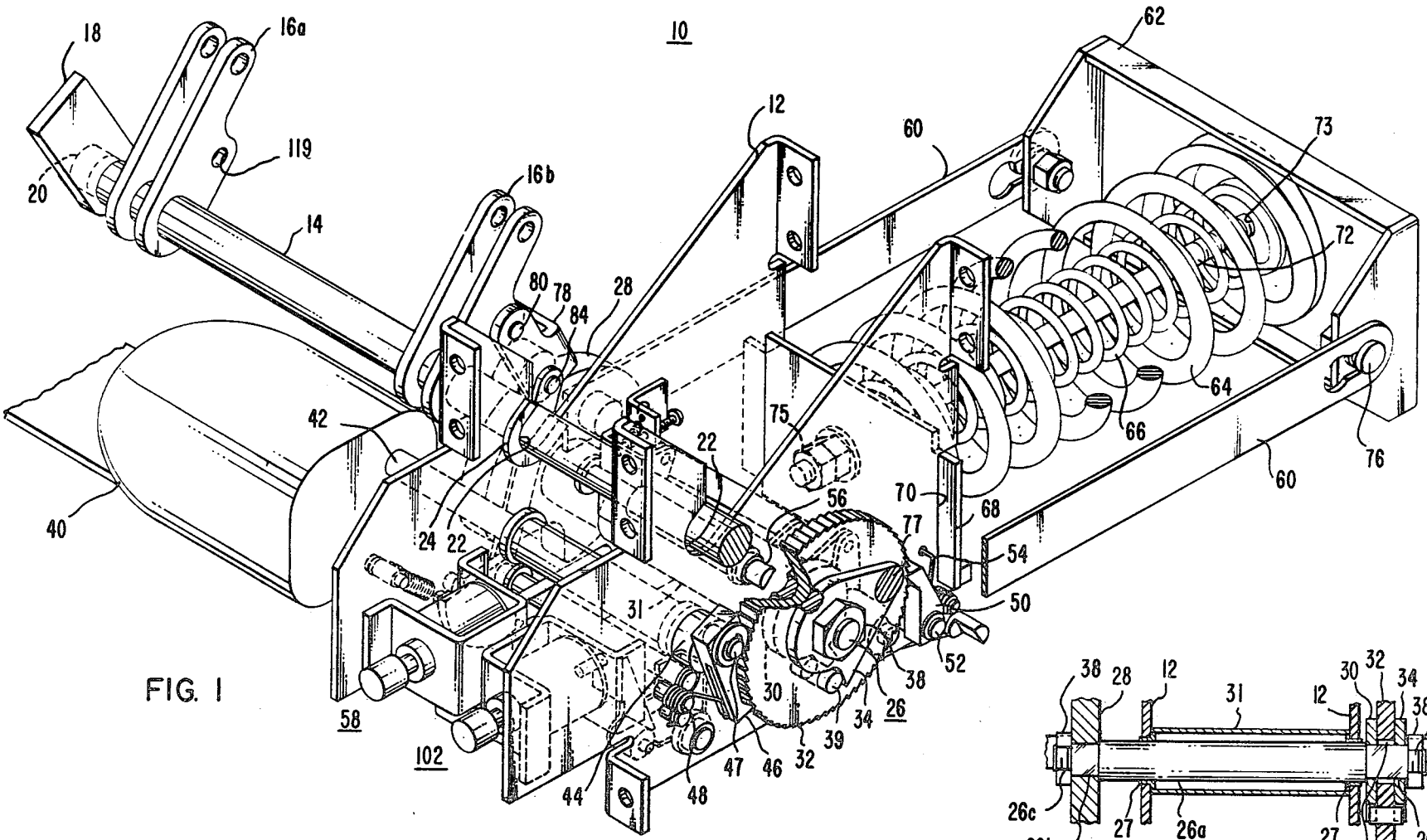
FIG. 1 shows an orthogonal projection of a circuit breaker apparatus operating mechanism, partially cut away.
Figure 2:
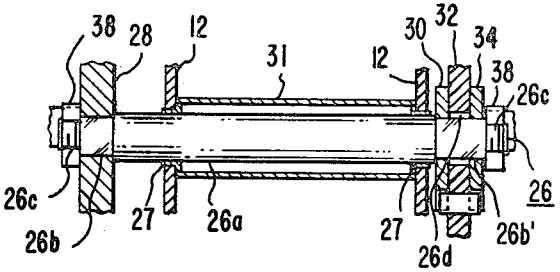
FIG. 2 shows an elevation in section of the cam shaft of FIG. 1 with its associated attached members (not to scale with respect to FIG. 1)
Figure 3:
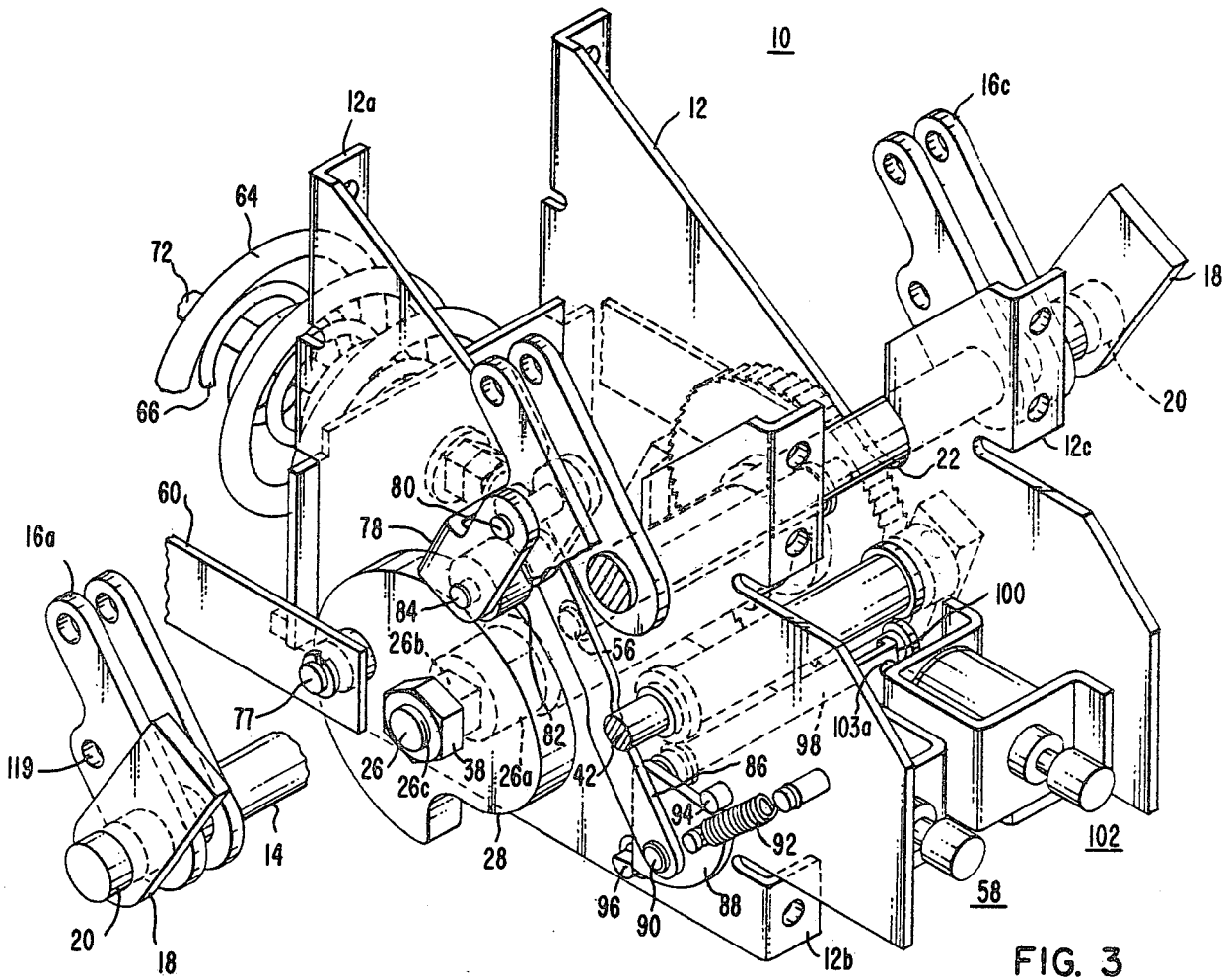
FIG. 3 shows an orthogonal view of the apparatus of FIG. 1 from another point of view.
Figure 4:
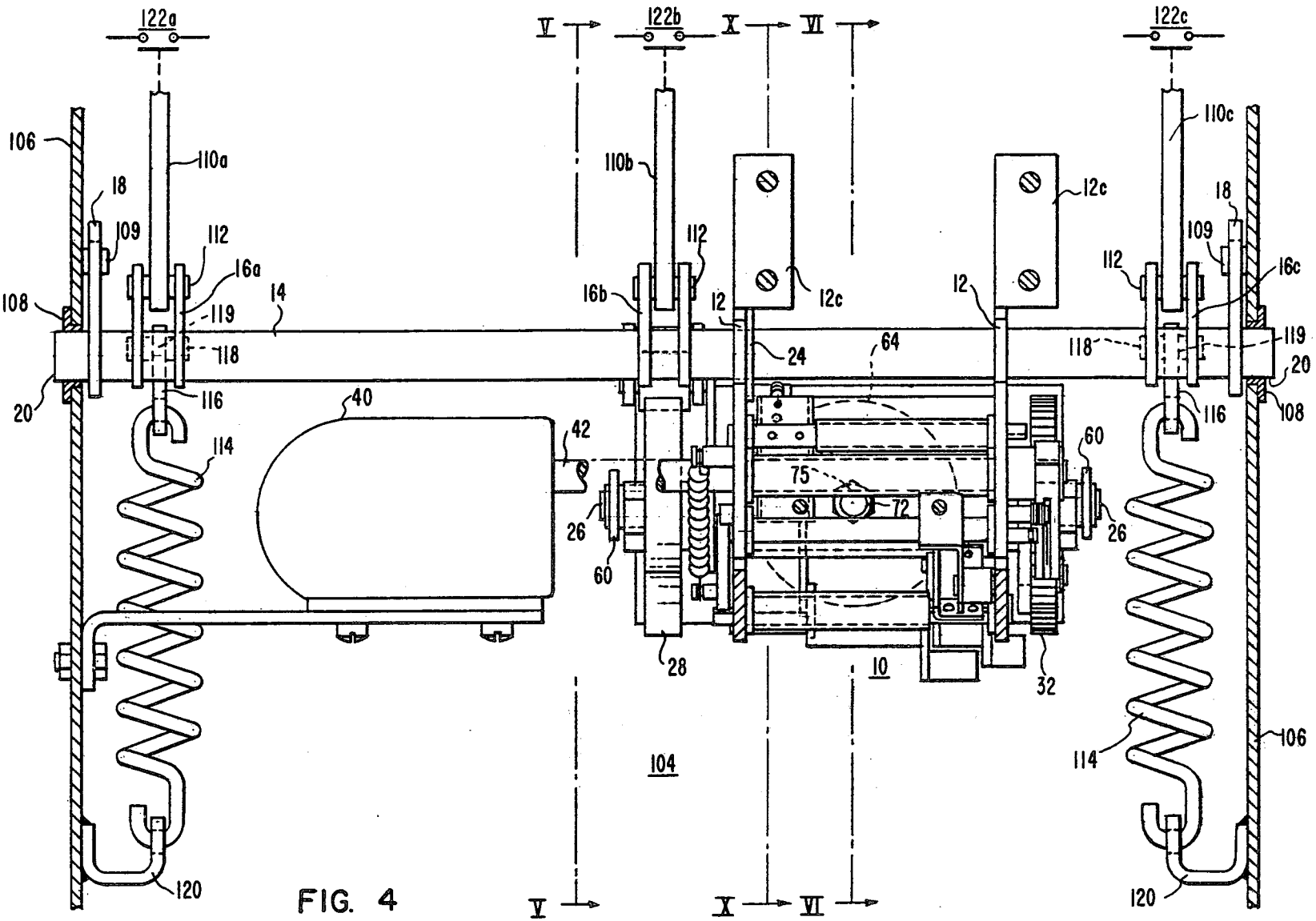
FIG. 4 shows a front elevation of the apparatus of FIGS. 1 and 2, partially in section.

Referring now to the drawings and FIGS. 1 through 4 in particular, circuit breaker apparatus with an operating mechanism 10 is shown. Operating mechanism 10 comprises two parallel, spaced apart support members 12. Support members 12 are generally the same size and shape and may be thus made by the same manufacturing process. Support members 12 comprise fastening tabs or flanges 12*a* at the upper rear portion thereof, 12*b* at the lower front portion thereof, and 12*c* at the upper front portion thereof. Disposed perpendicular to the parallel spaced support members 12 and generally protruding therethrough is a rotatable jack shaft member 14. Jack shaft member 14 has sets of generally equally spaced, securely fastened operating levers 16*a*, 16*b*, and 16*c* disposed thereupon for being rotatably moved when the jack shaft 14 is rotatably moved. Jack shaft 14 also has disposed thereon near the ends thereof, jack shaft rotational limiters 18 which may abut against stopping members (to be described hereinafter) for preventing rotational movement of the shaft beyond a certain angular position. The ends of the generally circular jack shaft 14 comprise bearing surfaces 20, the use of which will be described hereinafter. There is provided in each of the support members 12 a generally semicircular notch 22. In the semicircular notch 22 of the left-most member 12 as viewed in FIGS. 1, 3, and 4 is disposed a jack shaft half bearing 24. It is to be noted that the force which is supplied from the operating lever 16*b* against the jack shaft 14 is borne against the bearing 24 of the left-most member 12. This provides a deflection force or supporting region for the operating lever 16b which is relatively close to the operating member 16b. The latter arrangement tends to prevent substantial deflection of the shaft 14 at the longitudinal center thereof during opening and closing operations of the circuit breaker apparatus. It will be noted that the rotational limits of travel of the shaft 14 are such that the bite portion of the half bearing 24 is sufficient to provide an adequate bearing surface for the force offered by the rotational movement of the operating lever 16b during a contact opening or closing operation. It will be noted that this allows for the provision of a bearing surface which need not completely enclose the jack shaft 14 and thus which significantly reduces the complication of installing the jack shaft 14 in the operating mechanism 10. It will be noted that no bearing is disposed or needed in the semi-circular slot 22 of the right-most support member 12 as viewed in FIGS. 1, 3, and 4. There is also provided a cam shaft 26 which extends through both members 12 in a transverse orientation thereto. The cam shaft 26 may rotate for providing appropriate circuit breaker operations.

By referring to FIG. 2 specifically and FIGS. 1, 3, and 4 more generally, the geometric characteristics of the cam shaft 26 may be more clearly shown. In particular, cam shaft 26 comprises a circular center portion 26a. Shaft 26 may be fed through both members 12. Circular portion 26a is borne or supported by circular bearings 27 in both of the support members 12. Consequently, cam shaft 26 may rotate in the bearings 27. At either end of the circular portion 26a of the shaft 26 is a square or rectangularly shaped portion 26b on the left and 26b' on the right as viewed in FIG. 2. The characteristic square or rectangular shape may be provided by milling the circular stock of the shaft 26 in the appropriate regions. Alternatively the milling operation may be provided only along two parallel planes to provide parallel flats rather than four-sided square or rectangular geometric shapes for keying purposes. Furthermore, the ends of the key portions 26b and 26b' are machined and threaded at 26c to accept an appropriate nut or similar fastening device 38. On the left side as viewed in FIG. 2, a cam 28 having an opening similar in cross-section to the geometric shape of region 26b is keyed onto the shaft 26 and bolted against the left-most shoulder of the circular region 26a of the shaft 26 by turning the nut 38 on the threaded region 26c. In a similar fashion, in sequence, a closing latch 30, a ratchet 32, and a spring closing crank 34 are disposed upon the keyed region 26b' from the right-most shoulder of the circular region 26a of the shaft 26 to the nut 38 which is disposed on the right threaded portion 26 as viewed in FIG. 2. It is to be noted that the closing latch 30 and the spring closing crank 34 are keyed to the shaft region 26b'. However, the ratchet 32 is free to turn around the keyed region 26b'. The ratchet 32 is separated from the keyed region 26b' by an appropriate spacer 26d. The ratchet 32 is prevented from moving in a left-right direction with respect to the shaft 26 of FIG. 2 by the disposition of the closing latch 30 and the closing spring crank 34. A hollow cylindrical shell 31 is provided between the members 12 for enclosing the circular shaft portion 26a and providing a lubricating region therefor.

As can be best seen by reference to FIG. 1, a key 39 which protrudes from either side of the ratchet 32 picks up appropriate portions of the closing latch 30 and the closing spring crank 34 to move these latter two elements and the entire shaft 26 which is keyed thereto, once the free wheeling ratchet 32 has been rotated to the position shown in FIG. 1. It is also to be noted that the relative angular disposition of the protruding pin 39 with respect to the closing latch 30 and the closing spring crank 34 allows those latter two elements to rotate counterclockwise when necessary through a significant angluar disposition without necessitating corresponding movement of the ratchet 32.

Referring to FIGS. 1, 3, and 4 once again, spring charging motor 40 and a shaft 42 for the spring charging motor 40 is shown. Shaft 42 is disposed in and supported by the support members 12. Attached to the end of the shaft 42 which protrudes through the right-most support member 12 is an eccentric 44 to which is attached a driving pawl 46 by way of a pin 47. The driving pawl 46 is forced against the teeth of the ratchet 32 by the driving pawl spring 48. There is provided a stopping pawl 50 for preventing the ratchet wheel 32 from rotating in the clockwise direction as viewed in FIG. 1. The stopping pawl 50 is pivotally mounted upon a pin 52 and is forced against the teeth of the ratchet 32 by a stopping pawl spring 54. Pivotally disposed between the support members 12 and extending through the right support member 12 as viewed in FIG. 1, is a closing release shaft 56. The protruding or extending right-most end of the closing release shaft 56 has been milled to remove a semicircular portion of the cylindrical volume thereof. As will be described hereinafter, closing release shaft 56 operates in conjunction with a closing solenoid and manual pushbutton 58 to be rotated through a certain angular range when a circuit breaker opening operation is desired. When not actuated to begin a circuit breaker closing operation, the angular disposition of the closing release shaft 56 is such that the closing latch 30 becomes locked against the right side of the closing release shaft 56 as viewed in FIG. 1 due to the applied force of the closing spring as will be described hereinafter. To prevent counterclockwise motion of the shaft 26, the aforementioned cooperating characteristic of the closing release shaft 56 and the closing latch 30 will be described in more detail hereinafter with respect to other figures. Outboard of the support members 12 are complementary connecting rods 60. The connecting rods are oriented generally parallel to the predominantly flat surfaces of the members 12. The connecting rods 60 are attached at one end thereof to a closing spring yoke 62. Disposed against the inner surface of the yoke 62 as viewed in FIG. 1, are the ends of an outer coil closing spring 64 and an inner coil closing spring 66. Disposed against the other ends of the two previously mentioned coiled springs 64 and 66 is a closing spring support plate 68 which is conveniently anchored in grooves or notches 70 in the support members 12. A closing spring guide rod 72 extends axially through the coiled springs 64 and 66. The guide rod 72 is threaded at both ends thereof. One threaded end extends through an opening 73 in the yoke 62. The latter threaded end of the guide rod 72 has a complementary nut 74 threaded thereon (this arrangement may be best viewed by reference to FIG. 6). Likewise the other end of the rod 72 extends through a complementary opening in the spring support plate 68. The latter mentioned end has a complementary nut 75 threaded thereupon. The guide rod 72 as disposed in the operating mechanism 10 allows the yoke to move thereupon when the springs 64 and 66 are compressed or discharged while maintaining the latter mentioned spring in a generally workable disposition. The connecting rods 60 have enlarged openings at one end thereof for capturing a flanged pin 76 on the yoke 62. The opening in the end of the rod 60 allows for slight angular displacement of the rod 60 relative to the yoke 62 during a charging or discharging operation of the springs 64 and 66. Disposed at the end of the right closing spring crank 34 as viewed in FIG. 1, is a driving pin 77 (shown in section) which is captured by a notched opening in the other end of the rod 60, for thus disposing the rod 60 between the closing spring crank 34 and the yoke 62. (The latter arrangement is not shown in FIG. 1 because of the necessity of simplicity of illustration but is similar to the arrangement shown in FIG. 3 for fastening the rod 60 on the left to the cam 28.)

As can best be seen by reference to FIGS. 1 and 3, the left-most connecting rod 60 as shown in FIG. 1 and FIG. 3, is connected to the cam 28 by way of an appropriate driving pin 77. The driving pins 77, on cam 28 on the left and spring crank 34 on the right, are angularly aligned equally with respect to the shaft 26. This can be done because of the orientation of the shaft keys **26*b* and 26*b*' for the cam 28 and the spring crank 34 respectively. Because of this, when the shaft 26 rotates to provide a compression of the closing springs 64 and 66, the connecting rods 60 on both sides will uniformly draw the yoke 62 towards the spring support plate 68 maintaining both the yoke 62 and the support plate 68 in a generally parallel disposition. There is also provided for operating mechanism 10 a main link 78 which is pivotally hinged to the operating lever 16*b* by the pin 80, and which is pivotally linked with a cam shaft rider 82 by a pin 84**.

Figure 5:
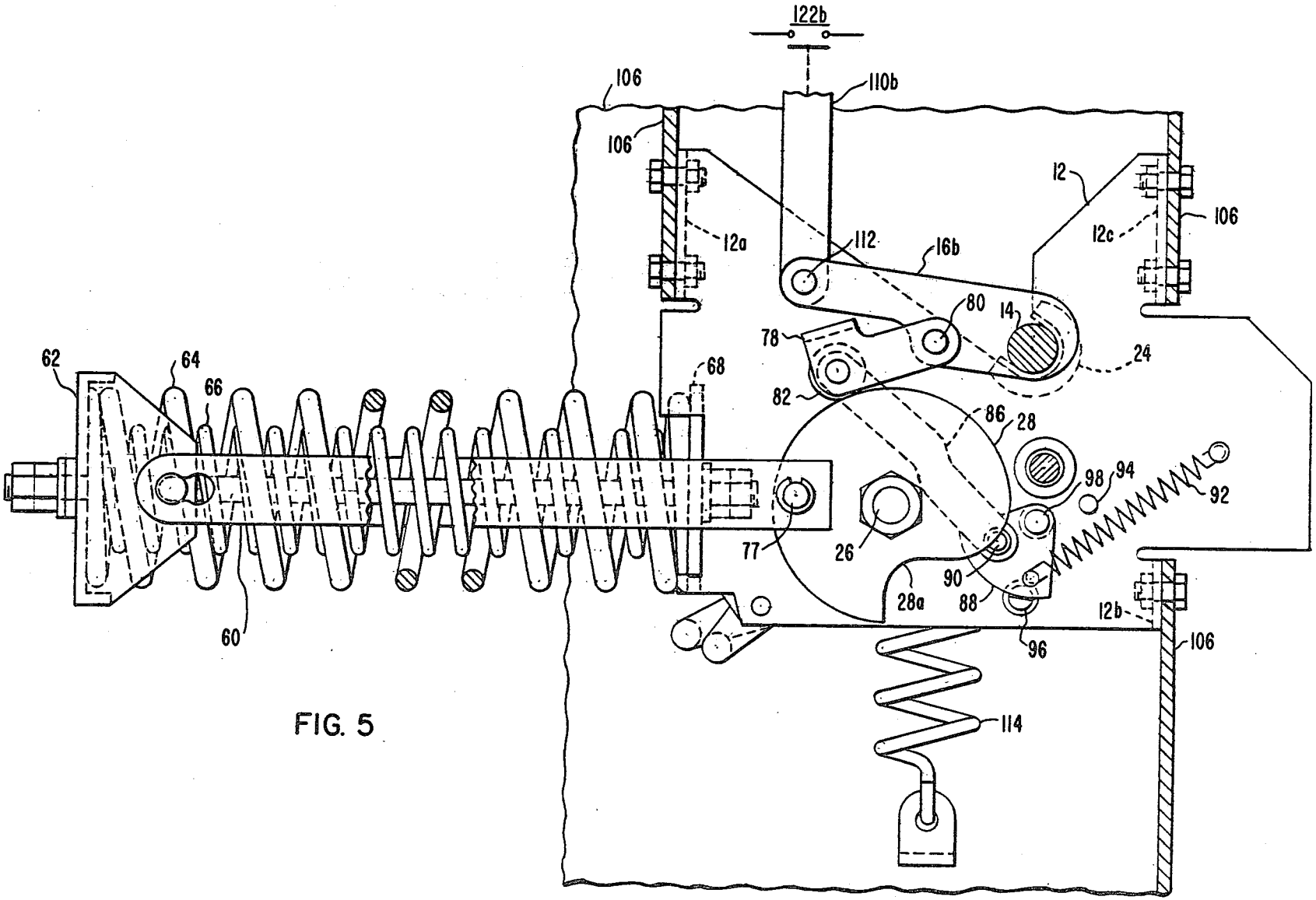
FIG. 5 shows a section of the apparatus of FIGS. 1, 2 and 4 at the section line V—V of FIG. 4 for the apparatus in a first operating position.
Figure 7:
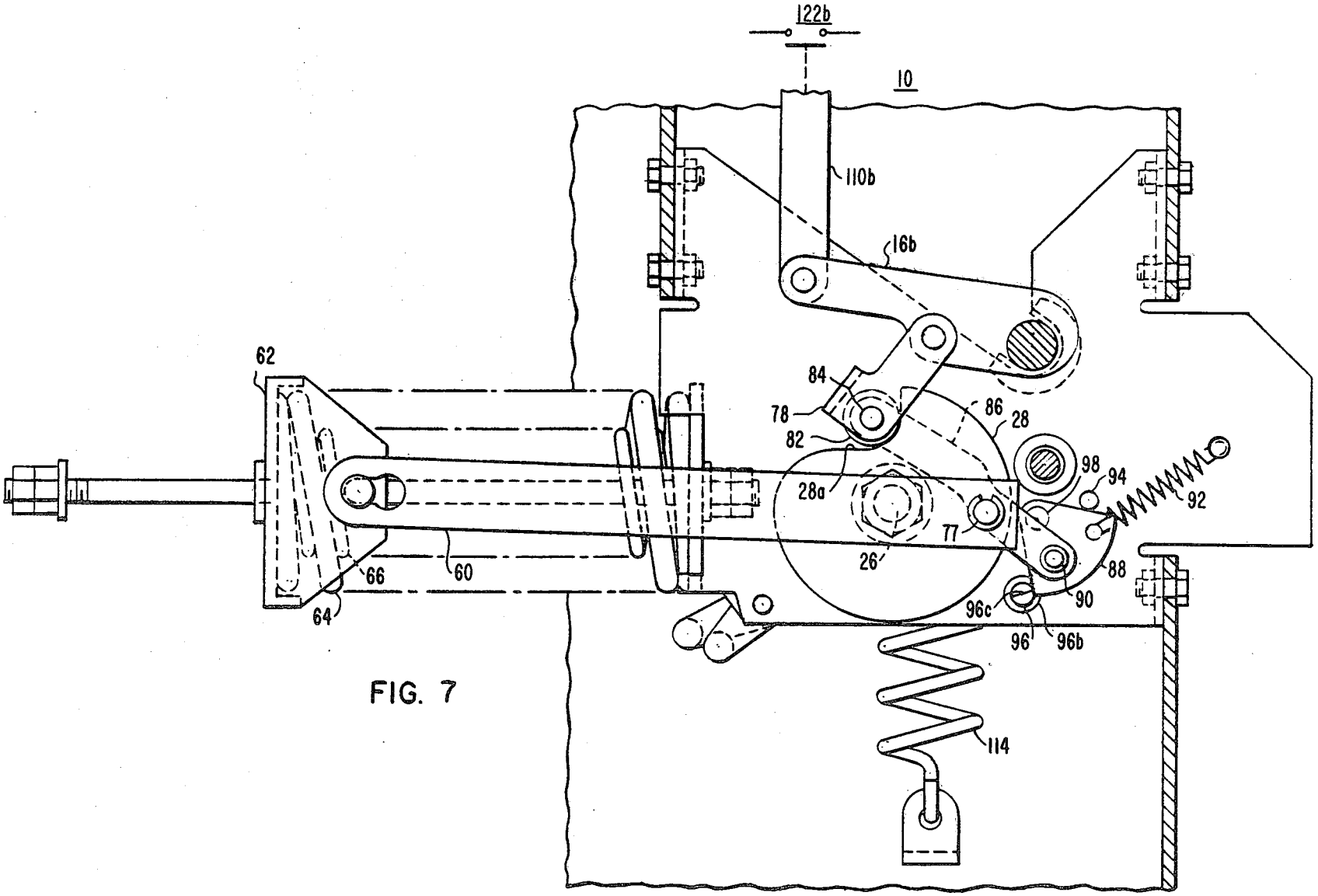
FIG. 7 shows a view similar to that of FIG. 5 but in a second operating position.

By referring to FIGS. 3, 5 and 7, it can be seen that a banana link 86 is interconnected at one end thereof with the pin 84 and consequently the cam rider 82. The other end of the banana link 86 is interconnected with a triangular shaped trip latch 88 by way of a pin 90. A trip latch spring 92 is connected at one end thereof to the trip latch 88 and at the other end thereof to an appropriate anchoring point on the left-most support member 12. The latter spring 92 attempts to provide sufficient spring force to maintain the trip latch 88 hard against a stop 94 on the left-most support member 12. Likewise, an opening release shaft 96 which is similar to and operates in a similar manner to the closing release shaft 56 described previously, is disposed between the support members 12 and protrudes from the left-most support member 12. The opening release shaft 96 when disposed in the angular position shown in FIGS. 3 and 7 for example, prevents the trip latch 88 from pivoting upon the shaft 98 in a clockwise direction as shown in FIG. 3 to thus allow the pin 90 to move significantly to the left as viewed in FIGS. 3 and 7. The complete operation of the trip latch 88 and its interaction with the shaft rider 82 and operating lever **16*b*** will be described in more detail hereinafter with respect to other figures.

Figure 6:
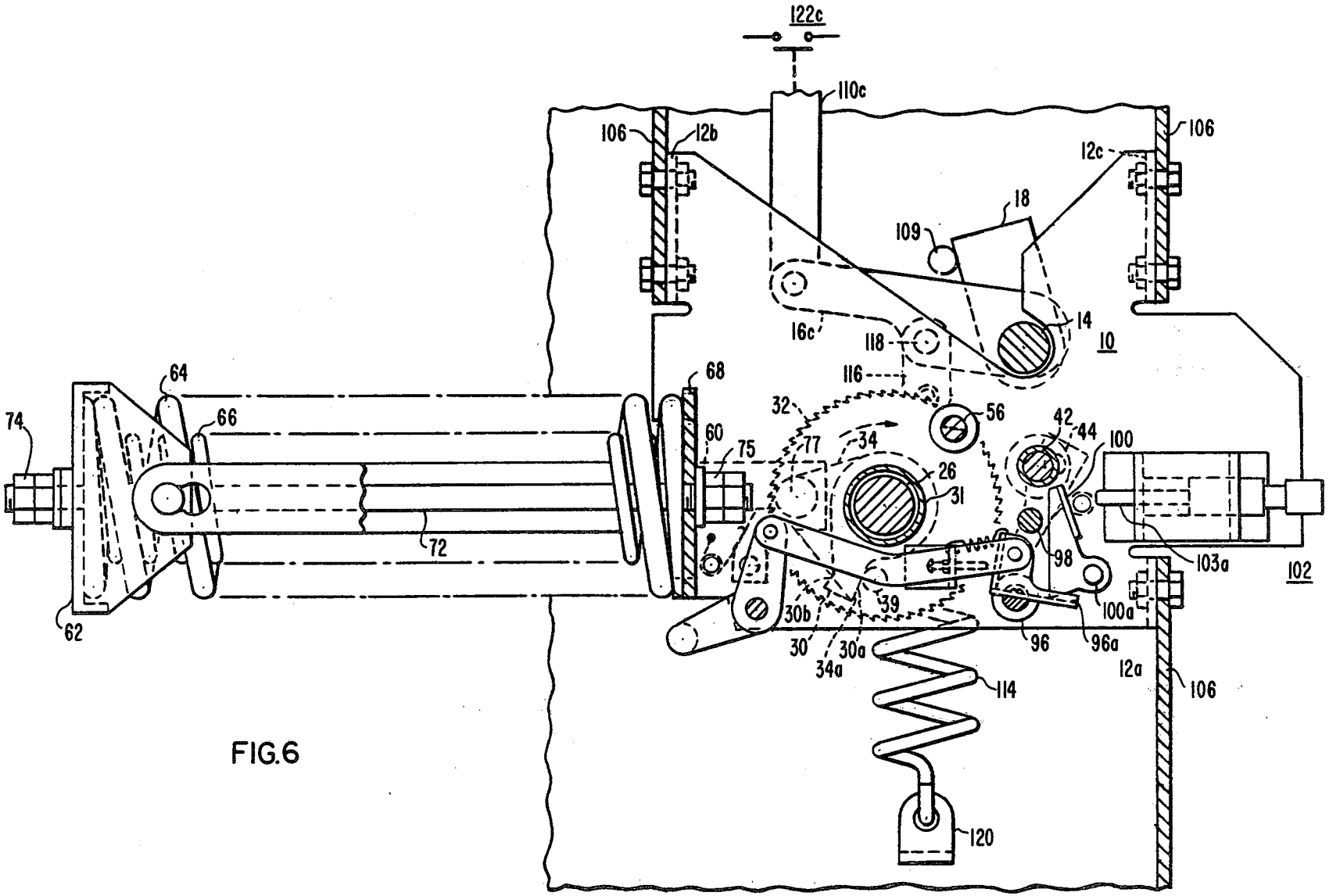
FIG. 6 shows a sectional view of the apparatus of FIGS. 1, 2 and 4 along the section line VI—VI of FIG. 4 for the first operating position described with respect to FIG. 5.
Figure 8:
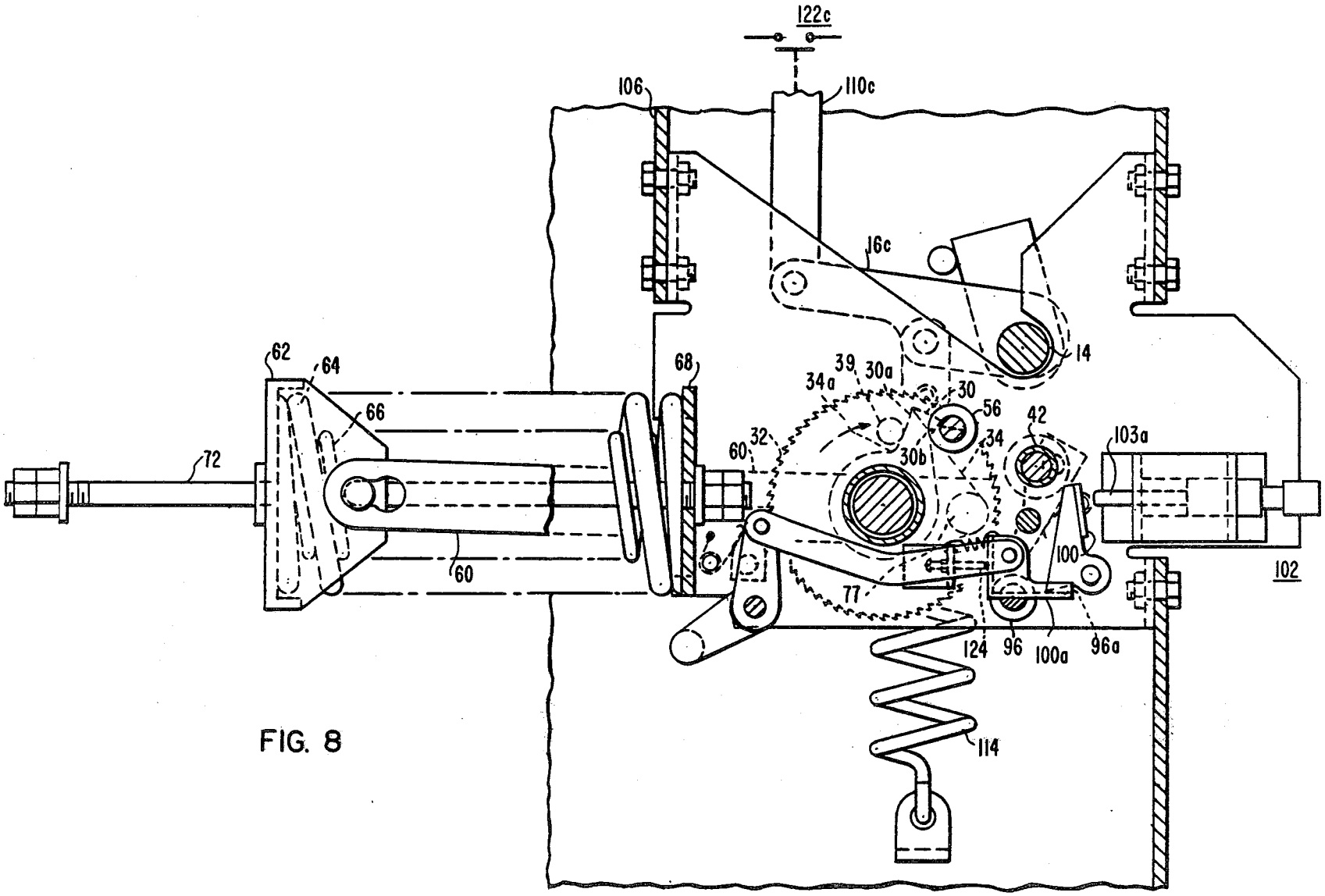
FIG. 8 shows a view similar to that of FIG. 6 but in a second operating position.

Referring now to FIGS. 3, 6, and 8, it can be seen that the angular disposition of the opening release shaft 96 is controlled by a shaft mounted lever **96*a* which in turn is controlled by a second lever 100 which when caused to move in a counterclockwise rotational direction about pivot 100*a* as shown in FIG. 6, will in turn cause the shaft mounted lever 96*a* to move in a clockwise direction thus rotating the shaft 96 in a clockwise direction. Sufficient rotational movement of the shaft 96 in the clockwise direction will free the left-most corner of the trip latch 88 thus allowing the pin 90 and banana link 86 to move to the left for purposes which will be described hereinafter with respect to other figures. Counterclockwise movement of the lever 100 is caused by right-to-left movement of the shaft 103*a* (as viewed in FIG. 6) of the trip solenoid and manual pushbutton 102**.

Referring now to FIG. 4, the disposition of the operating mechanism 10 within a circuit breaker apparatus 104 is shown. The disposition of the operating mechanism 10 relative to the remainder of the circuit breaker apparatus 104 may easily be determined by reference to previously described operating mechanism components. For example, the cam 28 is shown on the left and the ratchet wheel 32 is shown on the right. The spring charging motor 40 with its shaft 42 (partially broken away) is also shown. The disposition of the shaft 26 relative to the connecting rods 60, the cam 28 and ratchet wheel 32 is also shown. The outline of the large closing spring 64 is shown as well as the threaded end of the guide rod 72 with its complementary nut 75. The jack shaft 14 is shown extending from left to right in FIG. 4. The support structure or casing 106 of the circuit breaker apparatus 104 is shown broken away in FIG. 4. It will be noted that the outer bearing surfaces 20 of the jack shaft 14 are shown supported by bearings 108 disposed in the support cabinet or frame 106 of the circuit breaker apparatus 104. Likewise, the jack shaft half bearing 24 supported by and disposed in the left-most member 12 is also shown. The flanges **12*c* are shown in a supporting disposition with respect to the frame 106, the front part of which is not shown for convenience of illustration. There are also shown fixedly attached to the frame 106, limit of travel or stop pins 109 for the jack shaft rotation limiters 18 (reference to FIG. 6 will show the aforementioned elements in an elevated view). Electrically insulating connecting levers or rods 110*a*, 110*b*, and 110*c* are shown pivotally connected to the operating levers 16*a*, 16*b*, and 16*c*, respectively, with appropriate pins 112. Also shown are opening springs 114, which are connected to the operating levers 16*a* and 16*b* by links 116 and pins 118**.

By referring again to FIGS. 1 and 3 in addition to FIG. 4, it can be seen that the pins 118 reside in holes or openings 119 in the operating levers **16*a* and 16*c*, for example. The opposite ends of the opening springs 114 are connected to brackets 120 which are generally rigidly attached to the frame 106 of the circuit breaker apparatus 104**.

Referring once again to FIG. 4, it can be seen that the electrically insulating contact connecting rods **110*a*, 110*b*, and 110*c* are physically attached to schematically shown circuit breaker contacts 122*a*, 122*b*, and 122*c*, respectively. The previously described contacts 122*a* through 122*c*** may represent the three phase contacts of a three phase electrical system.

Referring again to FIGS. 1, 3, and 4, it can be seen that when it is desired to open contacts **122*a* through 122*c*, that an appropriate action may be taken such as actuating the trip solenoid or main pushbutton 102 to begin a sequence of events (to be described hereinafter with respect to other figures) which will eventually allow the jack shaft 14 to rotate under the force of the springs 114 to open the main contacts 122*a* through 122*c*. Similarly, a contact closing operation may be begun by actuating the closing solenoid or manual pushbutton 58 to begin a sequence of events (which will be described hereinafter with respect to other figures) which allows the closing springs 64 and 66 to rotate the jack shaft 14 against the force of the opening springs 114 to close the contacts 122*a* through 122*c* of the circuit breaker apparatus 104**.

OPERATION OF THE CIRCUIT BREAKER APPARATUS

Position 1: Closing Spring Discharged, Opening Spring Discharged, Contacts Opened Referring now to FIGS. 5 and 6 and previously described FIGS. 1, 3, and 4, a first operating position for the circuit breaker apparatus 104 will be described. In the first operating position, the contact closing springs 64 and 66 are discharged. The contact opening springs 114 are also discharged and the contacts 122*a* through 122*c* are opened. By referring specifically to FIG. 5, it can be seen that the cam 28 is in a position in which recess 28*a* therein generally faces downward. The opening release shaft 96 has been actuated to allow the trip latch 88 to be rotated about its pivot 98 in the clockwise direction. This action allows the cam roller 82 to move to the left as shown in FIG. 5. This forces the main link 78 and the operating lever 16*b* to pivotally collapse around the pin 80 thus allowing the insulating rod 110*b* to fall generally downward because of the interconnection therewith at pin 112 thus opening the contacts 122*b*. Concurrently the jack shaft 14 is rotated counterclockwise in the bearing 24. At this position, the trip latch spring 92 is charged to the extent that it has a tendency to attempt to rotate the trip latch 88 counterclockwise to a position against the stop 94 should the position of the banana link 86 change. In the disposition shown in FIG. 5, the crank pin 77 has been moved by the action of the discharging springs 64 and 66 operating against the yoke 62 with the connecting rod 60 to move the pin 77 to its furthest rotational position to the left as viewed in FIG. 5. This consequently sets the angular disposition of the cam shaft 26 which is keyed to the cam 28. The relative disposition of the flanges 12*a*, 12*b*, and 12*c* with respect to the frame 106 and the left-most support member 12 (as shown in FIG. 2 for example) is also depicted in FIG. 5.

Referring now to FIG. 6, the disposition of the closing latch 30, the closing spring crank 34, the ratchet 32, and the interlinkage between the trip solenoid and manual pushbutton 102, and the opening release shaft 96 (as was described previously) is shown. The discharged opening spring 114 is shown disposed between the bracket 120 and the pin 118 of the link 116. As is to be expected, the arrangement of the contacts 122*c*, the insulating connecting rod 110*c*, the operating lever 16*c*, the pin 118, and the jack shaft 14 is the same as that shown with respect to FIG. 5 (for another pole). Further rotational travel of the jack shaft 14 in the counterclockwise direction is limited by the abutment of the jack shaft rotation limiter 18 against the stop pin 109. The disposition of the closing release shaft 56 is shown in its normal angular displacement. The ratchet driving pin 39 is shown abutted against the driving surfaces 30*a* and 34*a* of the closing latch 30 and the closing spring crank 34 respectively. This means that rotational movement of the ratchet 32 in the direction of the arrow shown in FIG. 6 will force the closing latch 30 and the closing spring crank 34 to rotate similarly. The disposition of the spring crank pin 77 on the spring crank 34 is shown to be similar to the disposition of the pin 77 shown in FIG. 5, thus allowing the right connecting rod 60 to allow the yoke 62 to move as far to the left as possible with the arrangement shown in FIG. 6 thus discharging the springs 64 and 66. As was described previously with respect to FIG. 5, the disposition of the flanges 12*a*, 12*b*, and 12*c* on the support frame member 106 is shown.

In order to charge the closing springs 64 and 66 for a subsequent contact closing operation, it is necessary to rotate the charging motor shaft 42 to rotate the eccentric 44 to thus cause the driving pawl 46 as shown in FIG. 1 to move the teeth of the ratchet 32. This causes the pin 39 to cause the closing latch 30 and the closing spring crank 34 to move in the direction of the arrow as shown in FIG. 6. Naturally it can be seen that if the closing spring crank 34 is moved in the direction of the arrow, the pin 77 must follow therealong consequently drawing the connecting rod 60 to the right and upward. Since both the closing latch 30 and the closing spring crank 34 are keyed to the shaft 26, the shaft 26 will therefore be rotated clockwise.

Referring once again to FIG. 5, it can be seen that rotation of the cam shaft 26 in the clockwise direction will cause the cam 28 to rotate in a clockwise direction thus allowing the pin 77 to move to the right and upward similarly to the movement of the pin 77 shown and described with respect to FIG. 6. The corresponding, simultaneous movement of both pins 77 on the left-most and right-most connecting rods 60 will pull the yoke 62 evenly along the guide rods 70, thus compressing the springs 64 and 66 between the yoke 62 and the spring support plate 68. The shaft rotation depicted in FIGS. 5 and 6 will continue until the face 30*b* on the closing latch 30 as shown in FIG. 6 abuts against the closing release shaft 56.

Position 2: Closing Spring Charged, Opening Spring Discharged, Contacts Opened Referring now to FIGS. 7 and 8, the disposition of the operating mechanism 10 when the closing springs 64 and 66 have been charged, but where the contacts 122*a*, 122*b*, and 122*c* remain opened and the opening spring 114 remains discharged is shown. By referring specifically to FIG. 8, it can be seen that the ratchet 32 has been moved in the direction of the arrow by the rotation of the motor shaft 42 to push the closing latch 30 and the closing spring crank 34 by way of the pin 39 operating against the surfaces 30*a* and 34*a*, respectively, until an angular disposition is reached where the surface 30*b* of the closing latch 30 abuts against the closing release shaft 56. It will be noted that in this position, the cranking pin 77 on the spring crank 34 is almost at its extreme right position thus causing the right-most connecting rod 60 to cause the yoke 62 to compress the closing springs 64 and 66. It will be noted that the crank pin 77 is not at top dead center, or said in another way is not at its furthest right-most position. In fact, the pin 77 has been rotated in the clockwise direction (as viewed in FIG. 8) by the ratchet 32 acting upon the spring crank 34 to place the pin 77 in an angular disposition which is slightly past top dead center. This allows the springs 64 and 66 to discharge slightly against the yoke 62 thus pulling against the connecting rod 60 thus biasing the crank 34 to continue to rotate in a clockwise direction when the closing release shaft 56 is operated in such a way as to allow the closing latch 30 to rotate beyond it. If the pin 77 were at top dead center, then the likelihood for undesirable counterclockwise rotation of the spring crank 34 would be as great as the likelihood of desirable clockwise rotation. Since the spring crank 34 is keyed to the shaft 26, it is necessary for the spring crank 34 to rotate in the clockwise direction because it is necessary for the shaft 26 to rotate only in the clockwise direction (as viewed in FIG. 8). It will be noted with respect to FIG. 8 that even though the closing springs 64 and 66 have been charged, the relative disposition of the contacts 122c, the insulating connecting rod 110c, the operating lever 16c, the spring 114, and the jack shaft 14 remain unchanged with respect to FIGS. 5 and 6.

Referring now to FIG. 7, the corresponding disposition of the cam 28 is shown. In this case, the cam has rotated clockwise with respect to its position in FIG. 5, thus placing the cranking pin 77 in the same angular disposition as the cranking pin 77 of FIG. 8. This is to be expected as it is required that the left connecting rod 60 act upon the yoke 62 to compress the springs 64 and 66 the same as was shown with respect to FIG. 8 to prevent the yoke 62 from cocking. The rotation of the cam 28 by the keyed cam shaft 26 allows the shaft rider 82 to fall into the recess 28a of the cam 28, thus allowing the main link 78 to adapt a different disposition from that shown in FIG. 5. However, it will be noted as was mentioned previously with respect to FIG. 8, that the overall disposition of the contacts 122b, the insulating connecting rod 110b, and the operating lever 16b, remains unchanged from the disposition shown with respect to FIGS. 5 and 6. Since the shaft rider 82 was allowed to fall into the recess 28a, the pin 84 which is attached to the shaft rider 82 forces the banana link 86 to the right. Since the pin 90 on the trip latch 88 is moved by the motion of the banana link 86, the trip latch 88 must rotate to the right and counterclockwise about its pivot 98 under the influence of its spring 92 until it abuts against the stop 94. At this position, the flat cutaway portion 96c of the opening release shaft 96 is allowed to rotate to its normal position consequently locking the trip latch 88 against the portion 96b of the open release shaft 96.

Referring once again to FIG. 8, the disposition of the linkages between the shaft 96 and the trip solenoid and main pushbutton 102 is shown. In this case, the rotation of the shaft 96 places the shaft 96 in an angular position which is controlled by the stop screw 124. This in turn forces the lever 96a to force the point 100a to rotate the lever 100 in the clockwise direction to consequently place the lever 100 in a disposition to be moved counterclockwise once again by the action of the plunger 103a of the trip solenoid and main pushbutton 102. In the previously described second position, the closing springs 64 and 66 are in a disposition to close the main contacts when desired. It can be seen that if the closing release shaft 56 is rotated about its axis in a clockwise direction by appropriate apparatus (i.e. the closing solenoid and main pushbutton shown in FIG. 10) the force of the compressed springs 64 and 66 will tend to move the spring crank pin 77 thus causing the spring crank 34 to rotate clockwise until the springs 64 and 66 have been discharged. Since the spring crank 34 is keyed to the shaft 26, the shaft 26 must also turn counterclockwise.

Referring once again to FIG. 7, it can be seen that rotation of the cam shaft 26 in the clockwise direction would cause two things to happen. The first is that the discharging springs 64 and 66 will cause the connecting rod 60 to add to the torque applied to rotate the shaft 26 by moving the cranking pin 77 in a clockwise direction from right to left. In addition, the face of the cam 28 will cause the shaft rider 82 to move upwardly as the cam 28 rotates. It will be noted that the pin 84 which is connected to the banana link 86 which in turn is fixed at the pin 90, (because of the locked disposition of the trip latch 88) will only allow the pin 84 to move radially with respect to the pin 90. This causes the main link 78 to rotate the operating lever 16b clockwise thus elevating the insulating connecting rod 110b to thus interconnect the contacts 122b. Since the common jack shaft 14 rotates all three of the operating levers 16a, 16b, and 16c, all contacts 122a, 122b, and 122c are closed generally simultaneously. If during this latter contact closing operation a fault were somehow sensed on the lines interconnected with the contacts 122a through 122c, an appropriate signal would be provided to the trip solenoid 102 to quickly pivot the opening release shaft 96 clockwise thus allowing the relatively stationary pivot point 90 of the trip latch to move rapidly to the left as viewed in FIG. 7 to prevent the cam rider 82 from forcing the main link 78 upwardly even though the cam rider 82 itself begins to rise because of the changing contour of the cam 28. In this case it can be seen that the main link 78 would pivot in a clockwise direction about the pin 80 because of the newly provided freedom of motion of the banana link 86. This of course will prevent force from being supplied to the pin 80 for moving the operating lever 16b and consequently the electrically insulating rod 110b. Thus, the contacts 122b will remain open. This is known as the trip free mode of operation. Presuming however, that no trip free operation occurs, the final disposition of the various linkages, etc. after a contact closing operation has been completed is as shown in FIGS. 9 and 10.

Position 3: Opening Spring Discharged, Closed Spring Charged, Contacts Closed

Figure 9:
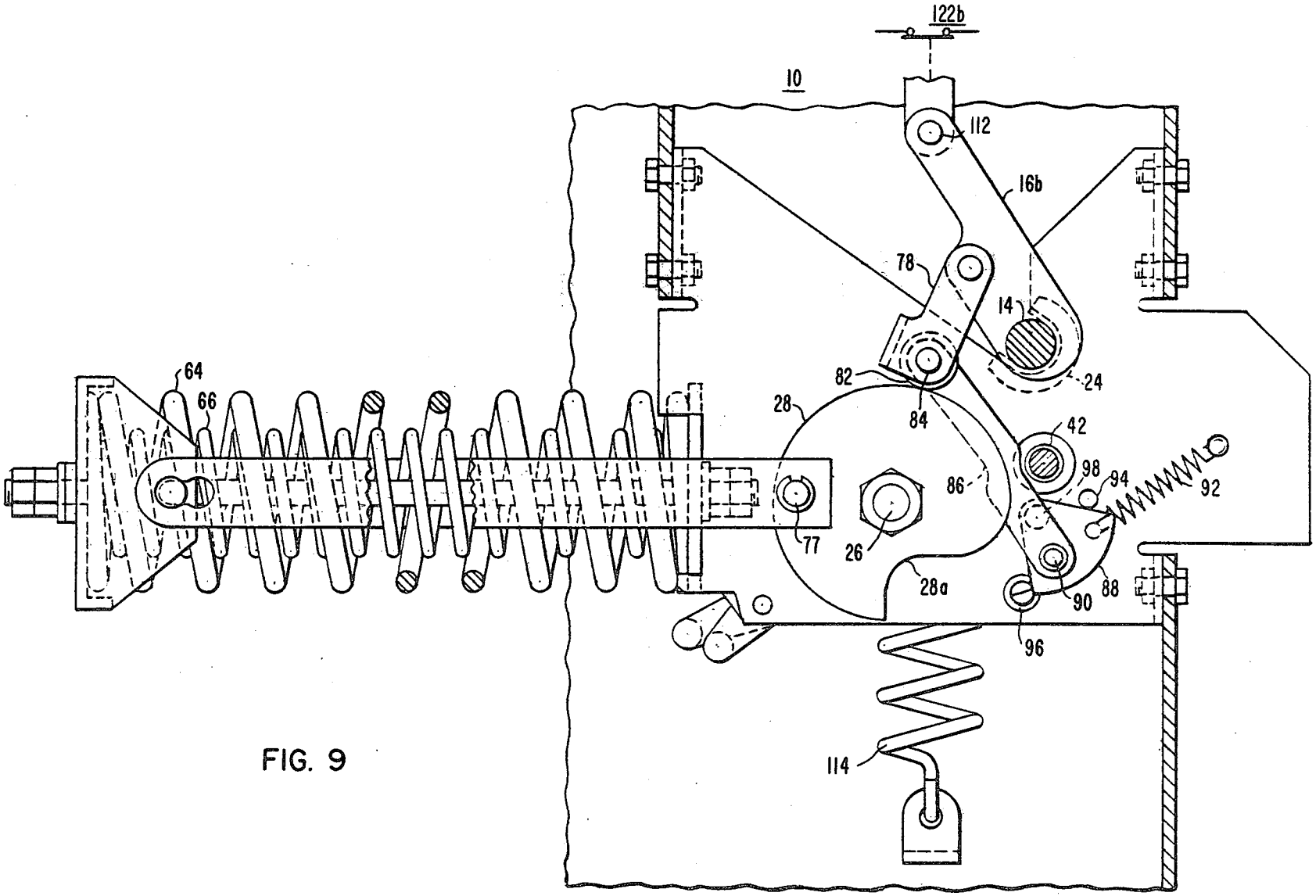
FIG. 9 shows a view similar to that of FIGS. 5 and 7 but in a third operating position.
Figure 10:
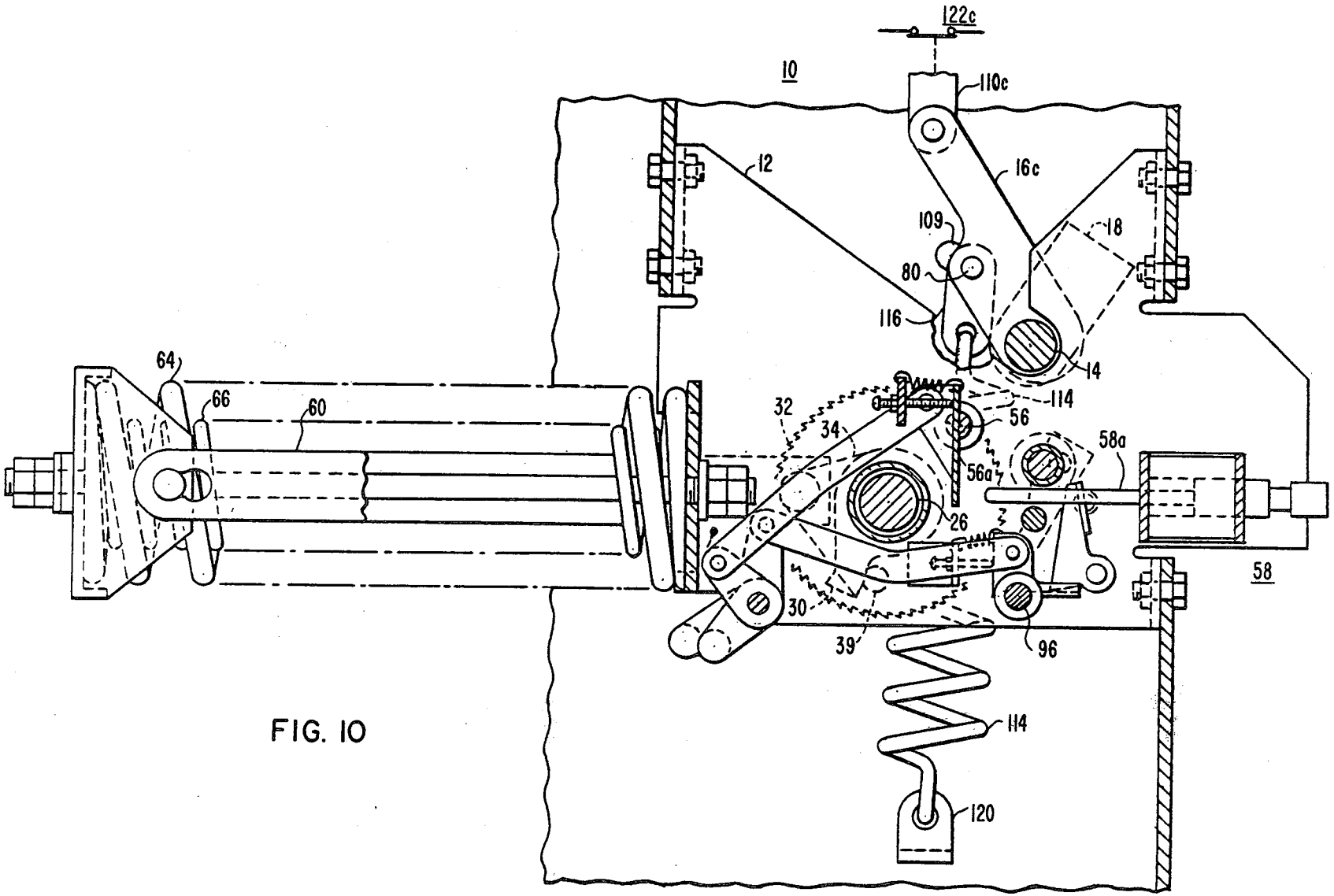
FIG. 10 shows a view similar to that of FIGS. 6 and 8 but in a third operating position.

Referring now to FIGS. 9 and 10, a third operating position for the circuit breaker operating mechanism 10 is shown. In this case, the closing springs 64 and 66 are discharged as they were in the first operating position shown in FIGS. 5 and 6. Consequently, the angular disposition of the shaft 56 is the same as the angular disposition shown in FIGS. 5 and 6. This means that the keyed cam 28, the keyed closing latch 30, and the keyed closing spring crank 34 all have the same disposition as that shown in FIGS. 5 and 6. It will be noted however that the difference between the first operating position as shown in FIGS. 5 and 6, and the third operating position as shown in FIGS. 9 and 10, lies in the angular disposition as of the jack shaft 14 and the apparatus which is connected thereto. To be more specific by referring to FIG. 10 and comparing FIG. 10 with FIG. 5 it can be shown that the angular disposition of the jack shaft for the third position (that shown in FIG. 10) is such that the operating lever 16c has been rotated further clockwise from the disposition of that shown in FIG. 6, thus causing the electrically insulating connecting rod 110c to move upward to close the contacts 122c. Likewise, since the jack shaft rotation limiter 18 is fixedly attached to the jack shaft 14, its angular position is now displaced away from the stop 109. Since the link 116 is affixed to the operating lever 16c by way of the pin 80, it can be seen that the opening spring 114 has been charged by raising the upper end of the spring 114 relative to the bracket 120.

Referring now to FIG. 9, the disposition of the cam 28 is shown. It will be noted as was mentioned previously that it occupies the same angular disposition as it occupied in the first disposition shown in FIG. 5. In this case however, as was described with respect to FIGS. 7 and 8, the trip latch 88 has been pivoted about its axis 98 by the discharging action of the spring 92 to place the trip latch 88 against the stop 94 thus allowing the opening release shaft 96 to assume its normal relaxed position. This tends to hold the trip latch 88 in the position shown in FIG. 9. Such beingthe case, the pivot 90 for the banana link 86 is fixed, and the disposition of the cam follower 82 on the surface of the cam 28 is forced by the banana link 86 through the common pin 84 to hold the main link 78 in an upright position relative to its disposition as shown in FIG. 5. This in turn holds the main operating lever **16*b* in an upward position. This causes the common pin 112 to hold the insulating connecting link 110*b* in such a disposition as to close the contacts 122*b*. Of course, as was mentioned previously, all of the contacts are controlled by the common jack shaft 14. Consequently, it can be said that all of the contacts 122*a* through 122*c*** are closed at this time.

Referring once again to FIG. 10, the arrangements of the closing solenoid and manual pushbutton 58 is shown. The latter solenoid has an extended plunger **58*a* which when actuated to move to the left causes the tab or lever 56*a* on the closing release shaft 56 to rotate clockwise. This changes the angular disposition of the milled away portion of the closing release shaft 56 for clearing the surface 30*b* of the closing latch (shown in FIG. 8). This allows the the springs 64 and 66 to discharge to rotate the shaft 26 to the position shown in FIGS. 10 and 6** for example.

By referring to FIGS. 8 and 10, it is to be noted that in a circuit breaker closing operation the disposition of the closing latch 30 and the closing spring crank 34 relative to the pin 39 on the ratchet 32 allows the springs 64 and 66 to discharge from the position shown in FIG. 8 to the position shown in FIG. 10. This causes the contacts **122*c* to move from the opened position shown in FIG. 8 to the closed position shown in FIG. 10 without requiring rotational movement of the ratchet wheel 32**.

Position 4: Closing Spring Charged, Contacts Closed, Opening Spring Charged

By referring to FIGS. 7, 8, 9, and 10, it can be seen that a fourth position for the apparatus and linkages of the operating mechanism 10 is possible. In this case, immediately after a circuit breaker has been successfully closed, that is immediately after the circuit breaker contacts **122*c* have been closed, it is desirous to once again quickly charge the closing springs 64 and 66 so that, upon the opening of the circuit breaker contacts 122*c* for example they may be quickly reclosed again. It is well known that a desired operating sequence for a circuit breaker is as follows: opening of the main contacts, reclosing of the main contacts, opening of the main contacts once again if necessary. By examining FIGS. 7 through 10, it can be seen that in the desired fourth position the closing springs 64 and 66 are in the disposition shown in FIGS. 7 and 8 and the main contacts 122*c* are in the disposition shown in FIGS. 9 and 10. In order to accomplish this, the motor 42 shown in FIGS. 1 and 3 for example, is allowed to rotate the shaft 42 to charge the springs 64 and 66 as was described previously without affecting the disposition of the contacts 122*c*. By examining FIGS. 7 and 9, it can been seen that the shaft 26 may be rotated clockwise through a sufficient angular displacement to move the closing spring crank pin 77 from the extreme left as shown in FIG. 9 to the spring charged position shown in FIG. 7. This may occur without the cam follower 82 changing its radial disposition relative to the shaft 26. In the spring charged position such as shown in FIG. 7, with the trip latch in the latched position such as shown in FIGS. 7 and 9, the cam follower 82 will not fall into the depression 28*a* as shown in FIG. 7. Rather it will remain on the outer large radius of the cam 28 until a tripping operation has been begun by angularly rotating the opening release shaft 96 to allow the trip latch 88 to assume the position shown in FIG. 5 for example. It will be noted with regard to the latter operation that the trip latch 88 will not reset itself, i.e. assume the position shown in FIG. 7 with the left side of the trip latch 88 abutting against the point 96*b* on the opening release shaft 96 until the roller 82 has been allowed to enter the depressions 28*a* such as is shown in FIG. 7. If the preceding sequence of events has occurred, then the circuit breaker apparatus is in condition for a quick reclosure after a prior opening merely by discharging the closing springs 64 and 66 in the manner described previously. In the event that the tripping operation took place on the discharged closing springs 64 and 66, consequent reclosure of the contacts 122*b* cannot occur until the motor or similar means 40 has rotated the shaft 42 to such a position that the springs 64 and 66 have been charged and the roller 82 has fallen to the recess 28*a***.

Although the utilization of an opening release shaft 96 in conjunction with a trip latch 88 is known, the utilization of a closing release shaft 56 in conjunction with a closing latch 30 for charging the opening springs 64 and 66 is believed to be novel.

Figure 11:
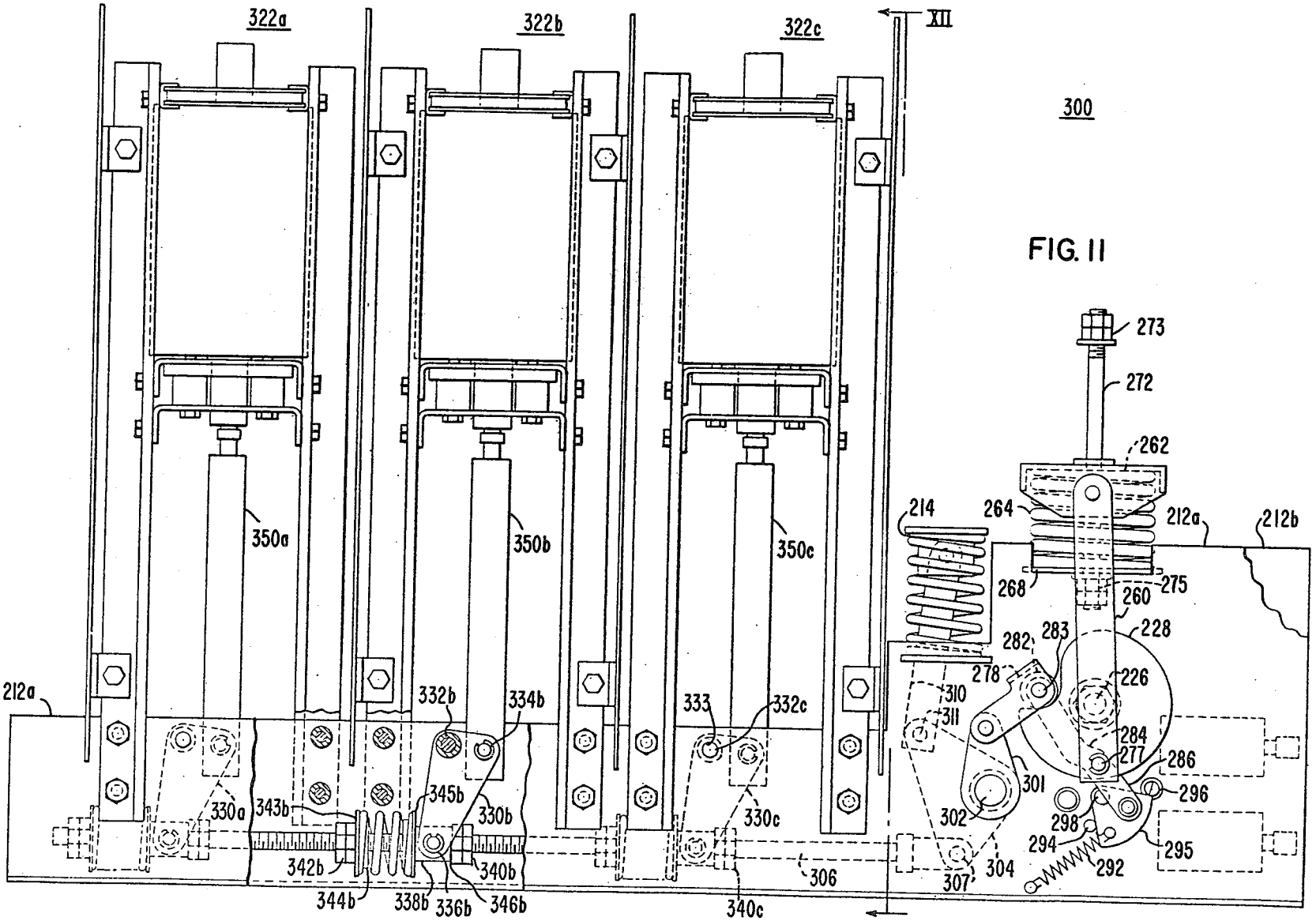
FIG. 11 shows a side elevation partially broken away of a vacuum circuit breaker apparatus and operating mechanism.
Figure 12:
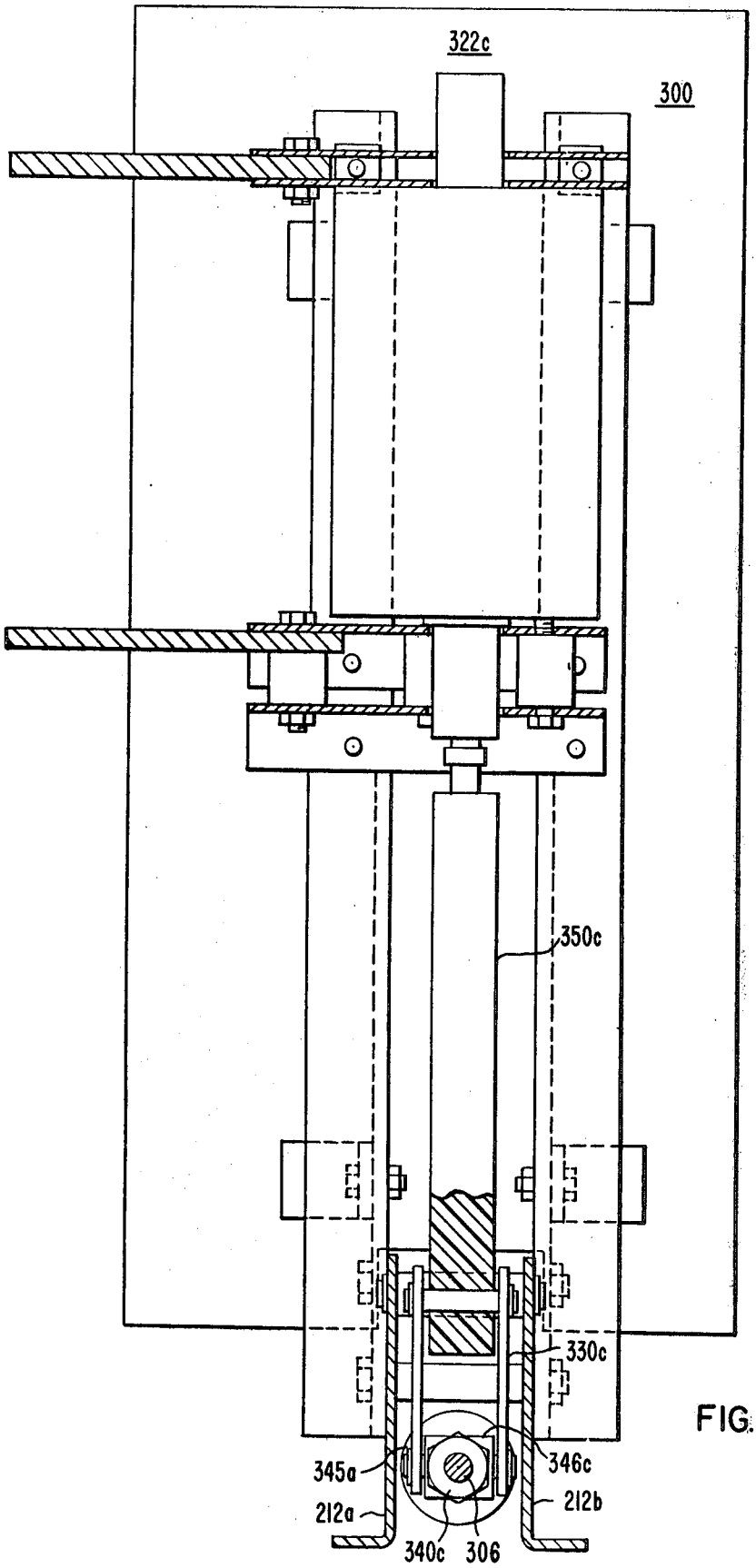
FIG. 12 shows a sectional view of the apparatus of FIG. 11 along the sectional lines XII—XII of FIG. 11.

Referring now to FIGS. 11 and 12, still another embodiment of the invention, a vacuum circuit interrupter 300 is shown. In this case there are provided two elongated, generally parallel, spaced apart unitary support members **212*a* and 212*b*. It will be noted that the latter two members support an operating mechanism, such as is shown to the right in FIG. 11, and the contact driving linkages and contact apparatus, such as is shown to the left in FIG. 11. In this embodiment of the invention, a shaft 226 traverses the space between the parallel plates 212*a* and 212*b*. Keyed to one side of the shaft 226 is a cam 228. A cam rider 282 is provided which is pivotally pinned to a banana link 284 and a main link 278. The main link is pivotally hinged to a cranking lever 301 which in turn is keyed or otherwise securely fastened to a rotatable jack shaft or crank shaft 302. Also securely attached to the jack shaft 302 is a bell crank 304, one end of which is pinned at 311 to a connecting rod 310 for an opening spring 214. The other end of the bell crank 304 is connected by way of a pin 307 to a driving rod 306. The previously described banana link 284 is connected to a trip latch 295 which is pivotable about a trip latch pivot 298. A spring 292 is provided to maintain the trip latch 295 against a stop 294. Likewise, an opening release shaft 296 of the type described with respect to FIGS. 1, 3, and 4 for example, is provided for allowing the trip latch 295 to rotate counterclockwise about the pivot 298 in appropriate circumstances for causing a trip motion to be applied to the rod 306. Spring crank pins 277 are disposed upon the cam 228 to actuate connecting rods 260 to compress an opening spring 264 between a spring support plate 268 and a yoke 262. As was the case with respect to other embodiments of the invention, a guide rod 272 is provided for the spring 264. A nut 273 is threaded on the upper end of the guide rod 272 and a similar nut 275 is threaded on the lower end thereof for securing the rod 272. There are provided three tandemly mounted vacuum bottle circuit breaker apparatuses or pole pieces 322*a*, 322*b*, and 322*c*. Insulating connecting rods 350***a*, 350*b*, and 350*c* are connected to the contacts (not shown) of the vacuum bottle circuit interrupters 322*a* through 322*c*, respectively. The bottoms of the insulating connectings rods 350*a* through 350*c* are connected to hinged ends 334*b* for example, on bell cranks 330*a*, 330*b*, and 330*c* respectively. The previously mentioned bell cranks are pivotal about pivot pins 332*b* and 332*c* for example for bell cranks 330*b* and 330*c*, respectively. A similar hinging arrangement exists for bell crank 330*a*. The pin 332*c*, for example, is supported in openings 333 in the previously described elongated support members 212*a* and 212*b*. The pins 332*a* and 332*d* may be likewise supported. Consequently it can be seen that the tolerance between the centers of the holes 333 for the bell cranks 330*a*, 330*b*, and 330*c* and the holes for the shaft or pivots 298 and 226 for example of the operating mechanism are maintained within relatively closed tolerances because of the unitary nature of the support members 212*a* and 212*b*. This is due to the fact that all the holes or openings are placed in unitary supports. The connecting rod 306 has nut members 340*b* and 342*b* disposed thereon for pole piece 322*b*. A nut member 340*c* is also shown for pole piece 322*c*. For purposes of simplicity of illustration, only the operating mechanism with respect to pole 322*b* will be further described, it being understood that the operating mechanism for poles 322*a* and 322*c* operate synchronously therewith and in a similar manner thereto. Disposed between the adjustable nut members 340*b* and 342*b* is a spring 344*b* which is maintained in place by spring support members 343*b* on the left and 345*b* on the right, as viewed in FIG. 11. Spring 344*b* encircles rod 306. There is provided a linkage block 338*b* upon which is disposed a hinge pin 336*b* on which a portion of the bell crank 330*b* rotates for opening and closing the contacts of the vacuum bottle interrupter 332*b*. The region between the block 338*b* and the nut 340*b* may expand to form a gap during certain operating conditions of the circuit breaker apparatus 300.

To close the contacts of the pole pieces 322*a* through 322*c* the electrically insulating rods 350*a* through 350*c* are raised by moving the connecting rod 306 towards the right as viewed in FIG. 11 to pivot in tandem and synchronously the bell cranks 330*a* through 330*c* in an upward direction. The connecting rod 306 is moved to the right by pivoting the shaft 302 counterclockwise. This occurs when the spring 264 is released to drive the cam 228 counterclockwise thus causing the cam rider 282 to force the cranking lever 301 to move in the counterclockwise direction. This also causes the pin 311 to drop, pulling the connecting rod 310 down thus compressing the opening spring 214.

To open the contacts 322*a* through 322*c*, the rod 306 must move to the left. This occurs when the opening trip release shaft 296 is rotated counterclockwise allowing the trip latch 295 to move upward in a counterclockwise direction thus freeing the banana link 284. This allows the spring 214 to discharge pulling the connecting rod 310 up thus rotating the bell crank 304 to the right in a clockwise direction.

During the contact closing operation, the nut 342*b* for example, is moved to the right by the connecting rod 306, transmitting the rightward directed motion through the spring 344*b* without significantly compressing that spring. This moves the block 338*b* to the right which in turn rotates the bell crank 330*b* counterclockwise, thus elevating the insulating connecting rod 350*b* to close the contacts of the vacuum circuit interrupter 322*b*, for example. After the contacts in the vacuum circuit breaker 322*b* have made contact with each other, further travel of the connecting rod 306 to the right tends to compress the spring 344*b* and to open or enlarge the gap in the region 346*b* between the block 338*b* and the nut 340*b*.

During a contact tripping or opening operation, when the rod 306 moves to the left, the force of acceleration of the discharging opening spring 214 will rapidly cause the gap 346*b* to close. This is assisted by the action of the expanding spring 344*b* which also tends to accelerate the nut 340*b*. At the instant the nut 340*b* impacts the block 338*b* from the right a large force of acceleration is transferred to that block which in turn tends to move the electrically insulating rod 350*b* downward with great force thus tending to break any welds which may have formed between the contacts of the vacuum interrupters 322*a* through 322*c* during the closing operation. The force of acceleration provided by the spring 344*b* and the opening spring 214 tends to jar or shake the entire mechanism 300. The force is required as the previously described contact welds are often a serious problem with vacuum bottle interrupter contacts. If the support members for the operating mechanism of FIG. 11 were physically separated from the support members for the vacuum bottle interrupters, the repeated forces of acceleration during the contact opening operation would eventually tend to misalign the various critical alignment elements, i.e. the alignment between pin 332*c* and shaft 226 for example. However, because of the unitary nature of the support members 212*a* and 212*b*, it is very difficult to misalign the critical component parts for the apparatus of the vacuum circuit interrupter 300.

It is to be understood with respect to the embodiments of this invention that the concept of the outboard operating mechanism components is not limited to the particular type of stored energy mechanism shown in FIGS. 1 through 10. Furthermore, it is to be understood that the spacing between the support members 12 in the embodiment of FIGS. 1 through 10 and the support members 212*a* and 212*b* in the embodiment of FIGS. 11 and 12 is not limiting. It is also to be understood that the concepts associated with the embodiments shown in FIGS. 1 through 10 is not limited to any particular kind of circuit breaker. The circuit breakers may be vacuum breakers, magnetic circuit breakers, gas circuit breakers, or others. In a like manner, even though the embodiment described with respect to FIGS. 10 and 11 deals primarily with vacuum type circuit interrupters, the concepts taught with respect to the latter embodiment are not limited to vacuum type circuit interrupters. It is also to be understood that the type of operating mechanism shown in FIGS. 3 and 11 is not limiting. It is also to be understood that the energization and control of motor 40 may be as described in well-known prior art.

The apparatus taught in the various embodiments of this invention have many advantages. One advantage lies in the fact that a circuit breaker operating mechanism may be provided with supports which are inboard of all the critical operating components such as the cam, the ratchet, and the closing spring connecting rods. Another advantage lies in the fact that such an arrangement allows for a simply made and installed cam shaft. Still another advantage lies in the fact that one of the support members for the operating mechanism may be utilized to bear the force of the center pole of a three phase circuit breaker, thus tending to reduce jack shaft deflection. Another advantage lies in the fact that a specially milled or machined closing release shaft may be utilized in conjunction with a closing latch for efficient and effective closing of the circuit breaker contacts. Another advantage lies in the fact that one of the connecting rods for the closing spring may be connected directly to a pin on the cam. Still another advantage lies in the fact that in one embodiment of the invention, unitary support members are provided for maintaining close alignment tolerances between portions of the circuit breaker operating mechanism and portions of the circuit breaker contact opening and closing linkages.

What I claim as my invention is:

1. A circuit interrupter, comprising:

(a) a base;

(b) three separable main contact means disposed upon said base;

(c) three lever means, one for each of said separable main contact means interconnected with said contact means for moving said contact means;

(d) rotatable jack shaft means for moving said lever means, each end of said jack shaft means being disposed in thrust bearing relationship with said base for substantially bearing the thrust from the two outer of said three lever means as said contact means moves; and (e) operating mechanism means disposed upon said base for moving said jack shaft means, said operating mechanism means comprising a pair of spaced support members, said operating mechanism means also comprising a cam the shaft of which is movably supported by said pair of spaced support members but which is disposed outboard thereof for actuating said jack shaft means to rotate in appropriate circumstances for thus moving said contact means, only one of said pair of support members also having a bearing surface thereon which engages said jack shaft means relatively near said middle lever means of said three lever means for substantially bearing the thrust of said middle lever means as said contact means moves, said middle lever means also being disposed outboard of said pair of spaced support members.

2. The combination as claimed in claim 1 wherein only that support member of said pair which is closest to said middle level means having said support means bearing surface thereon.

3. The combination as claimed in claim 1 wherein said support means bearing surface comprises a half bearing.

4. The combination as claimed in claim 2 wherein said support means bearing surface comprises a half bearing.

5. The combination as claimed in claim 4 wherein said three separable main contact means interconnect with conductors of a three phase electrical system.

* * * * *